US007381695B2

(12) United States Patent
Minevski

(10) Patent No.: US 7,381,695 B2
(45) Date of Patent: Jun. 3, 2008

(54) TIRE WHEEL CLEANER COMPRISING AN ETHOXYLATED PHOSPHATE ESTER SURFACTANT

(75) Inventor: Liliana Minevski, The Woodlands, TX (US)

(73) Assignee: Shell Oil Company, Houston, TX (US)

( * ) Notice: Subject to any disclaimer, the term of this patent is extended or adjusted under 35 U.S.C. 154(b) by 85 days.

(21) Appl. No.: 11/554,447

(22) Filed: Oct. 30, 2006

(65) Prior Publication Data

US 2007/0117732 A1 May 24, 2007

Related U.S. Application Data

(60) Provisional application No. 60/731,830, filed on Oct. 31, 2005.

(51) Int. Cl.
*C11D 1/86* (2006.01)
*C11D 3/30* (2006.01)

(52) U.S. Cl. ..... 510/189; 510/212; 510/245; 510/253; 510/254; 510/363; 510/401; 510/426; 510/427; 510/467; 510/477; 510/499; 510/504

(58) Field of Classification Search ..... 510/189, 510/212, 245, 253, 254, 363, 401, 426, 427, 510/431, 467, 477, 499, 504
See application file for complete search history.

(56) References Cited

U.S. PATENT DOCUMENTS

| | | | | |
|---|---|---|---|---|
| 4,457,322 A | | 7/1984 | Rubin et al. | 134/2 |
| 4,895,675 A | | 1/1990 | Smith | 252/539 |
| 5,250,652 A | * | 10/1993 | Langer et al. | 528/125 |
| 5,395,542 A | | 3/1995 | Nozaki et al. | 252/174 |
| 5,556,833 A | | 9/1996 | Howe | 510/189 |
| 5,622,569 A | | 4/1997 | Dennis et al. | 134/2 |
| 5,733,377 A | | 3/1998 | Howe | 134/3 |
| 5,776,880 A | | 7/1998 | Mondin et al. | 510/365 |
| 5,866,528 A | | 2/1999 | Cala et al. | 510/423 |
| 5,891,839 A | | 4/1999 | Erilli et al. | 510/426 |
| 5,904,735 A | * | 5/1999 | Gutierrez et al. | 8/137 |
| 5,929,004 A | | 7/1999 | Ushijima et al. | 510/100 |
| 6,339,054 B1 | | 1/2002 | Levitt et al. | 510/241 |
| 6,432,899 B1 | | 8/2002 | Sjostrom | 510/245 |
| 6,864,220 B2 | | 3/2005 | Levitt et al. | 510/424 |
| 2005/0003990 A1 | | 1/2005 | Smith et al. | 510/421 |

FOREIGN PATENT DOCUMENTS

| | | |
|---|---|---|
| WO | WO92/08824 | 5/1992 |
| WO | WO93/06950 | 4/1993 |

* cited by examiner

*Primary Examiner*—Charles I Boyer

(57) ABSTRACT

An aqueous tire wheel cleaner composition useful for cleaning automobile tires are provided. The aqueous tire wheel cleaner composition contains an alkali and/or alkaline earth metal hydroxycarboxilic acid or a quaternary amine ethoxylate; a salt of an aryl sulfonate, and as surfactants ethanol amine and an ethoxylate phosphate ester.

21 Claims, No Drawings

TIRE WHEEL CLEANER COMPRISING AN ETHOXYLATED PHOSPHATE ESTER SURFACTANT

The present application claims the benefit of U.S. Provisional Patent Application Ser. No. 60/731,830, filed Oct. 31, 2005 the entire disclosure of which is hereby incorporated by reference.

FIELD OF THE INVENTION

The present invention relates to a composition and process to clean tire wheels.

BACKGROUND OF THE INVENTION

Tire wheels are mounted on tires of automobiles and hence a variety of grime can be deposited on the tire wheels in an amount increased with time. The condition of wheels has a major effect on the over all appearance of a car. However, in the course of driving wheels come across a variety of environmental conditions. They are constantly subjected to an array of aggressive contaminants including brake dust, salt, and traffic film.

In addition to heated particles from brake pads, discs, and brake lining, which bombard coated or uncoated wheel surfaces, there are also particles from air and dirt/soil from roads that easily adheres to the rough build up, which also incorporates a range of salts and acids. Composition of soil may vary with location and driving conditions. However, harm is always more pronounced in the presence of moisture, which reacts with soil, and break dust and coatings become destroyed followed by damage of the wheels.

In general, dirt found on wheels is from organic and inorganic origin. Organic dirt includes mineral oil, vegetable oil, animal fat and fine particles of carbon black and graphite, while dust, traffic dirt and metal particulates from break dust are considered inorganic. The composition of brake pads may vary by type of resin used as well as on the metal ratio. Thus due to the variability of road soil and brake dust, the material to be cleaned from each vehicle wheel varies every time it is cleaned.

SUMMARY OF THE INVENTION

In accordance with one embodiment of the invention, there is provided an aqueous tire wheel cleaner composition comprising:

(a) water;

(b) a surfactant comprising:

(i) alcohol amine; and (ii) an ethoxylate phosphate ester;

(c) an alkali and/or alkaline earth metal hydroxycarboxilic acid or a quaternary amine ethoxylate; and (d) a salt of an aryl sulfonate.

In another embodiment of the invention, a method of cleaning a tire wheel using the aqueous tire wheel cleaner composition is provided.

DETAILED DESCRIPTION OF THE INVENTION

A variety of metal cleaners are used to clean metal parts. For example, solvent-based metal cleaners that are in use contain either halogenated or non-halogenated hydrocarbons. The use of such solvent-based cleaners has raised environmental and/or consumer safety concerns. On the other hand, non-halogenated hydrocarbon solvents such as toluene, ketones and alcohols are generally flammable, highly volatile and are not appropriate for use. The other cleaners usually consist of strong acids such as phosphoric, hydrochloric, sulfuric, oxalic, acetic, hydroxyacetic, hydrofluoric, and citric acids, as well as blends of the various acids such as described in U.S. Pat. Nos. 5,556,833 and 5,733,377. Though these products are effective in removing road soils from wheels they have disadvantage in being highly corrosive to wheels, paints and plastics and tend to strip paint and chrome and discolor aluminum and chrome.

There are also wheel cleaner based on alkaline hard surface cleaners such as described in U.S. Pat. No. 4,457,322. These consist mainly of detergents, water-soluble organic solvents such as glycol ether, and alkaline materials such as sodium hydroxide, potassium hydroxide, and/or any of the alkaline silicates and phosphates. The disadvantage of these products is that they are not very effective at cleaning wheel soils, and can damage painted and aluminum surfaces. Also, if they are allowed to dry on the surface, they have the tendency of leaving insoluble residues. U.S. Pat. No. 5,929,044 describes a method using a color changing indicator to indicate timing for removing the tire wheel cleaner.

Thus, many of the current aqueous cleaning systems have drawbacks since they contain sodium hydroxide, acids or organic solvents, which are exceedingly alkaline (pH of 10-14) or acidic (pH of 0.5 to 6.0) and are highly corrosive to metal surfaces, highly toxic and can be dangerous to handle.

It has been difficult to obtain an aqueous cleaner, which has a moderate i.e., neutral pH of about 6.5 to about 9.5, and which is effective in removing grease, oil, and break dust contaminants from metal substrates, e.g., automotive wheels, and which would not be corrosive to the metal substrates, especially aluminum.

In general, wheels are part of the vehicle that requires regular washing and cleaning to preserve the best condition and new look. There are various materials used to manufacture wheels: aluminum, chrome, stainless steel, painted steel, painted aluminum, mirror polished aluminum, clear coated aluminum, alloys, various protective coatings, and plastic. Some of these materials, particularly aluminum, are very sensitive to current highly alkaline or highly acidic products found on the market.

There is a need for a wheel cleaner that can clean the wheels without detrimental effect on its metallurgy, i.e., pitting, etching, or hazing the surface of the wheel. The present exemplary embodiments, among other things, address and overcome one or more of the above deficiencies associated with conventional wheel cleanser and provide an improved wheel cleaner.

The aqueous tire wheel cleaner composition contains water in an amount of from about 30 weight percent, preferably from about 40 weight percent, more preferably from about 50 weight percent, up to about 90 weight percent, preferably up to about 85 weight percent, more preferably up to about 83 weight percent, based on the aqueous tire wheel composition.

In a preferred embodiment, component (c) is preferably present in an amount of 0.1 weight percent, preferably 1 weight percent, more preferably 2 weight percent, to about 10 weight percent, preferably to about 8 weight percent, more preferably to about 6 weight percent. In a preferred embodiment, the alkali and/or alkaline earth metal hydroxycarboxilic acid may be any hydroxycarboxilic acid salt that is soluble in water. Preferred alkali and/or alkaline earth metal may be sodium, potassium, or magnesium, more preferably sodium or potassium. Hydroxycarboxilic acid may be for example, hydroxyl functional carboxylic acid having 3 to 10 carbon atoms. Preferred hydroxycarboxilic acid may be, for example, gluconic acid, tartaric acid, citric acid and lactic acid.

Preferably, the alkali and/or alkaline earth metal hydroxycarboxilic acid is present in an amount of from about 0 weight percent provided that at least one quaternary amine ethoxylate is present in the composition, preferably from about 0.1 weight percent, more preferably from about 2 weight percent, to about 5 weight percent, preferably to about 3 weight percent, based on the aqueous tire wheel composition.

In a preferred embodiment, the quaternary amine ethoxylate may be any cationic quaternary amine ethoxylate that is soluble in water. The anion can be any anion that is useful with the cationic quaternary amine ethoxylate, preferably acid anions such as, for example, chloride, iodide, bromide, fluoride, acetate, phosphate, sulfate, etc. One embodiment of the quaternary amine ethoxylate may be described by the general formula:

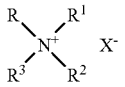

wherein at least one of R, $R^1$, $R^2$ and $R^3$ is an ethoxylate group, preferably having an average of about 12 ethoxylate moiety, and two or three of R, $R^1$, $R^2$ and $R^3$ is an alkyl group, preferably fatty alkyl group. More preferably two of R, $R^1$, $R^2$ and $R^3$ is an ethoxylate group and two of R, $R^1$, $R^2$ and $R^3$ is an alkyl group. X is an anion as described above. Preferably, the quaternary amine ethoxylate is present in an amount of from about 0 weight percent provided that at least one alkali and/or alkaline earth metal hydroxycarboxilic acid is present in the composition, preferably from about 0.1 weight percent, more preferably from about 1 weight percent, to about 5 weight percent, preferably to about 3 weight percent, based on the aqueous tire wheel composition.

In a preferred embodiment, the surfactant is an alkaline stable surfactant. Preferred surfactant contains (i) alcohol amine, and (ii) an ethoxylate phosphate ester. In another preferred embodiment, surfactant contains (i) ethanol amine, (ii) an ethoxylate phosphate ester and (iii) an ethoxylate sulfate ester. The surfactant is preferably present in an amount of from about 0.5 weight percent, more preferably from about 2, to about 15 weight percent, more preferably to about 5 weight percent, based on the aqueous tire wheel composition.

Alcohol amine is preferably present in an amount of from about 0.5 weight percent, preferably from about 1 weight percent, to about 10 weight percent, more preferably to about 5 weight percent, based on the aqueous tire wheel composition. Preferred alcohol may be any alcohol having 2 to 6 carbon atoms. Preferred alcohol may be, for example, triethanol amine, diethanol amine, ethanol amine, or mixtures thereof.

Ethoxylate phosphate ester and/or ethoxylate sulfate ester is preferably present in an ethanol amine to ethoxylate phosphate ester and/or ethoxylate sulfate ester weight ratio of from about 170:1, more preferably from about 80:1, to about 3:2, more preferably to about 2:1. The preferred ethoxylate phosphate ester and/or ethoxylate sulfate ester have a number average molecular weight in the range of about 200 to about 1000, more preferably about 200 to about 500. The ethoxylate moiety of the ethoxylate phosphate ester and/or ethoxylate sulfate ester can be mono-, di- or tri-ethoxylate or mixtures thereof. The ethoxylate sulfate ester when present, is present in an amount of ethoxylate phosphate ester to ethoxylate sulfate ester weight ratio of from about 1:100, more preferably from about 1:30, to about 1:1, more preferably to about 1:10.

Other surfactant or emulsifiers such as a quaternary fatty alkyl alkoxylate, and alcohol ethoxylates can be present in the aqueous tire wheel cleaning composition. Such other surfactant or emulsifiers may be present in an amount of 0, more preferably from about 2 weight percent, up to about 5 weight percent, more preferably up to about 3 weight percent, of the aqueous tire wheel cleaning composition. Other surfactant (or emulsifiers) include, for example, ethoxylated branched and linear $C_{10}$-$C_{12}$ alcohols, tall oil acid, tallow alcohol ethoxylate, and other surfactants such as amphoteric surfactants such as, for example, cocoamidopropyl betaine; cocoamidopropyl hydroxy sultaine; anionic surfactants such as, for example, sodium dodecylbenzene sulphonate, sodium lauryl ether sulphate; and nonionic surfactants such as, for example, nonylphenol ethoxylate, sorbital esters, sorbitan monooleate. In a more preferred embodiment another surfactant such as an alcohol ethoxylate is preferably present in an amount about 0.1 weight percent to about 5 weight percent based on the aqueous tire wheel cleaning composition.

In a preferred embodiment, coupling agent may be a salt of an aryl sulfonate. Preferred salt of an aryl sulfonate may be, for example, xylene sulfonate salt, toluene sulfonate salt or cumene sulfonate salt. In one preferred embodiment, coupling agent is present in the aqueous tire wheel cleaning composition in an amount of from about 3 weight percent, preferably from about 5 weight percent, to about 15 weight percent, preferably to about 10 weight percent, based on the aqueous tire wheel composition.

The aqueous tire wheel cleaning composition may also contain other components such as protective polymer coatings.

The aqueous tire wheel cleaning composition may be made by blending or mixing the components (a)-(d) and any additional components in any order to provide the aqueous tire wheel cleaner. The blending or mixing is preferably conducted in any manner known to provide substantially uniform concentration of the components.

The method of cleaning the wheel may be by spraying on the aqueous tire wheel cleaning composition and wiping off or rinsing off the aqueous tire wheel cleaning composition with water and wiping to shine. The present exemplary embodiments are effective as, spray on, wipe off cleaner, which may effectively remove most of traffic/automotive soil contaminants from automobile tire wheel substrates such as alloy, aluminum, anodized, steel, paint and plastic trimmed wheels, preferably without harm to the various metallurgies/materials used in wheel production. By cleaning regularly, wheels will retain their original finish and resist the damage, which can be caused by brake dust. The aqueous tire wheel cleaning composition is a neutral alkaline aqueous cleaning composition, which has a pH from 6.5 to 9.5. Thus, a tire wheel with dirt on the tire wheel may be cleaned by applying the aqueous tire wheel cleaner composition to the tire wheel, removing at least a portion of the dirt on the tire wheel along with the aqueous tire wheel cleaner composition applied to the tire wheel.

A substrate may be cleaned with the aqueous tire wheel cleaning composition by contacting the substrate with the aqueous tire wheel cleaning composition for a period of time sufficient to remove substantial portion of the contaminants from the substrate. The aqueous tire wheel cleaning composition may be applied in a sprayable liquid state onto the tire wheels. It wets the grime adhered to the surface of the tire wheels and allows it to come off from the tire wheels. Upon this the cleaning composition with grime is wiped off or removed away by water.

The following examples illustrate the compositions and method of the present invention. The examples are for illustrative purposes only and are not intended to limit the scope of the invention.

EXAMPLES

The ingredients and amounts of each ingredient used in the compositions are shown in Table 1 below.

Surmax™ Surfactant CS515 is an alkaline stable surfactant blend containing triethanol amine and an ethoxylate sulfate ester and ethoxylate phosphate ester (approximately 60 weight percent, approximately 10-20 weight percent and approximately 1-5 weight percent, respectively, in an alkoxyalkanol ethoxylate solution) manufactured by Rutgers Organics.

SXS40 is sodium xylene sulfonate.

Videt Q3 is an ethoxylated quaternary amine based surfactant containing approximately 60-95 weight percent of ethoxylated quaternary amines and approximately 40-5 weight percent alcohol ethoxylates with pH of 6-9 manufactured by Vitech International Inc.

Videt DRP is a blend of surfactants containing approximately 10-15 weight % of sodium xylene sulfonate and a tertiary carbon phenolic compound and a polymer manufactured by Vitech International Inc.

All examples were blended by mixing in water the components listed in Table 1 at room temperature.

TABLE 1

| | Example 1 | Example 2 | Example 3 | Example 4 | Comparative Example 1 (CP1) |
|---|---|---|---|---|---|
| Deionized water (wt. %) | 83.5 | 81 | 87 | 81 | 85 |
| Sodium gluconate (wt. %) | 3 | 2 | 0 | 3 | 0 |
| Surmax CS515 (wt. %) | 1.9 | 4 | 1 | 4 | 4 |
| Videt DRP (wt. %*) | 2.8 | 3 | 3 | 4 | 3 |
| SXS 40 (wt. %) | 6 | 8 | 5 | 8 | 8 |
| Videt Q3 (wt. %) | 2.9 | 2 | 4 | 0 | 0 |
| pH | 7.00 | 7.20 | 6.80 | 7.00 | 7.20 |

Test Data A

Visual evaluation was noted on several occasions during the application and use of the aqueous tire cleaning composition listed in Table 1. The results of the visual evaluation is provided in Table 2: when sprayed, after rinsing, after wiping and rated as Fair (20% or less cleaned off), Good (more than 20% to less than 50% cleaned off), Very Good (50% or more to 80% cleaned off) and Excellent (more than 80% cleaned off) based on the amount of dirt taken off the panels. Commercially available Tire Wheel cleaning materials were also tested:

Comparative 2 (CP2)

Highly alkaline tire wheel cleaner having pH of 13 containing sodium metasilicate, and nonionic and cationic surfactants.

Comparative 3 (CP3)

Acidic wheel tire cleaner having pH of 4.4 containing ammonium bifluoride.

The effectiveness of wheel cleaner was evaluated (1) using dispersion of break dust and test dust in water. Aluminum panels were sprayed with brake dust solution made form 5 g of ISO 12103-1 A1 ultra fine test dust and 5 g brake dust from 1999 Dodge Grand caravan 3.3.L dispersed in 1 l of tap water. The pH of such solution is about 6. After applying ten or twenty sprays, panels were left to dry for 24 hours in oven at 50° C. Upon cooling to room temperature cleaning evaluation started by spraying panels with wheel cleaners listed in Table 1. Panels were left for ~30 sec to soak before rinsing with a stream of tap water, and then dried by wiping off. Evaluation methods used: visually evaluation, photography and weight measurements using analytical balance; (2) cleaning actual wheels on various types of vehicles. Weight measurements, of aluminum strips, were taken before applying break dust solution, after drying in oven and after immersion in wheel cleaner solutions, which was followed by rinsing with water and drying in oven for at least two hours.

TABLE 2

| Ranking for Type of cleaning | Comparatives | Formulation Examples |
|---|---|---|
| Fair | CP1, CP2 | |
| Good | CP3, | 3, 4 |
| Very Good | | 1, 2 |

From this evaluation it can be seen that the neutral formulation of the invention has better or equivalent cleaning ability than the comparatives.

Test Data

ROAD GRIME: Dirt mixture was applied onto aluminum metal panels. Road grime consisted of two parts: part I—1 g of each test dust (ultra fine, fine, medium, and coarse) dispersed into 24 g of water; part II—1 g of carbon black and 1 g break dust (from 1999 Dodge Grand Caravan 3.3.L) dispersed in 35 g of each oil (motor oil 10W30 and heavy duty motor oil 15W40). These two grimes were mixed together and then applied in amount of ~1 g onto each panel (3×6 inch). Panels were left to dry at room temperature for 72 hours. They were cleaned by applying 20 sprays of each composition listed in Table 5, rinsed with water and wiped dried. For each composition, three panels are used. Panels are subjected to the appropriate test e.g., dirtying and then cleaning. Gloss readings at 20 degrees angle of illumination are taken before dirtying the system and after cleaning and results are shown in Table 3. Measurements are based on ASTM D 523 standard test method for specular gloss.

TABLE 3

| Panels | CP2 | Example 1 | water |
|---|---|---|---|
| 1 | −85.8 | −74.3 | −91.2 |
| 2 | −92.2 | −59.1 | −84.7 |
| 3 | −78.7 | −55.1 | −74.7 |

Data shows that the there is difference in gloss readings between Example 1, CP3 and water (less negative numbers indicate shinier surface). The composition of the invention improves gloss and shine more than CP3 and/or water. Thus, the composition of the invention improves the appearance of metal surface by cleaning and making it shinier.

These panels were exposed to outside weathering and environmental conditions such as dust, temperature 29.4-32.2° C. (85-90° F.), humidity (70-90%) and gloss readings were taken after 5, 10 and 20 days at 20 degrees angle of illumination. Results are shown in Table 6 (higher numbers indicate shinier surface).

TABLE 4

| | $R_3$ | Example 1 | water |
|---|---|---|---|
| Cleaned | 53.9 | 67.1 | 46.5 |
| 5 days | 48.7 | 66 | 50.4 |
| 10 days | 45.8 | 65.5 | 50.5 |
| 20 days | 40.1 | 67.6 | 54.8 |

It can be seen from the table 4 that surfaces cleaned with the composition of the invention will remain shiner than comparative example and/or surfaces cleaned with water.

I claim:

1. An aqueous tire wheel cleaner composition comprising:
(a) water;
(b) a surfactant comprising:
(i) alcohol amine; and
(ii) an ethoxylate phosphate ester;
(c) an alkali and/or alkaline earth metal hydroxycarboxylic acid or a quaternary amine ethoxylate; and
(d) a salt of an aryl sulfonate.

2. The composition of claim 1 wherein the surfactant further comprises:
(iii) an ethoxylate sulfate ester.

3. The composition of claim 1 wherein the tire wheel cleaner composition further comprises:
(e) an alcohol ethoxylate.

4. The composition of claim 1 wherein the alcohol amine is ethanol amine.

5. The composition of claim 1 wherein component (c) comprises an alkali and/or alkaline earth metal hydroxycarboxylic acid.

6. The composition of claim 5 wherein component (c) further comprises a quaternary amine ethoxylate.

7. The composition of claim 1 wherein component (c) comprises a quaternary amine ethoxylate.

8. The composition of claim 1 having a pH of from about 6.5 to about 9.5.

9. The composition of claim 6 wherein component (b) is present in an amount of about 0.5 weight percent to 15 weight percent, based on the weight of the aqueous tire wheel cleaner composition.

10. The composition of claim 8 wherein component (c) is present in an amount of about 0.1 weight percent to about 10 weight percent, based on the aqueous tire wheel composition.

11. The composition of claim 8 wherein component (d) is present in an amount of about 3 weight percent to about 15 weight percent, based on the aqueous tire wheel composition.

12. The composition of claim 8 wherein component (a) is present in an amount of about 30 weight percent to 90 weight percent, based on the aqueous tire wheel composition.

13. The composition of claim 8 wherein component (i) is present in an amount of from about 0.5 weight percent to about 10 weight percent, based on the aqueous tire wheel composition.

14. The composition of claim 8 wherein component (i) and (ii) are present in an amount of an alcohol amine to ethoxylate phosphate ester weight ratio of from about 170:1 to about 3:2.

15. The composition of claim 2 wherein components (i) and (ii) are present in an amount of an alcohol amine to ethoxylate phosphate ester weight ratio of from about 170:1 to about 3.2, and components (ii) and (iii) are present in an amount of an ethoxylate sulfate ester to ethoxylate sulfate ester weight ratio of from about 170:1 to about 3:2.

16. The composition of claim 15 wherein component (i) is present in an amount of from about 0.5 weight percent to about 15 weight percent, based on the aqueous tire wheel composition.

17. The composition of claim 3 wherein component(e) is present in an amount of about 0.1 to about 5, weight percent based on the aqueous tire wheel composition.

18. The composition of claim 1 wherein the ethoxylate phosphate ester has a number average molecular weight in the range of about 200 to about 1000.

19. The composition of claim 2 wherein the ethoxylate sulfate is present in an amount of ethoxylate phosphate ester to ethoxylate sulfate ester weight ratio of from about 1:100 to about 1:1.

20. A method of cleaning a substrate comprising contacting the substrate with the aqueous tire wheel cleaning composition of claim 1 for a period of time sufficient to remove a substantial portion of the contaminants from the substrate.

21. A method of cleaning a tire wheel comprising applying the aqueous tire wheel cleaner composition of claim 1 to a tire wheel, removing at least a portion of the dirt on the tire wheel along with the aqueous tire wheel cleaner composition applied to the tire wheel.

* * * * *